US011352236B2

(12) United States Patent
Erny

(10) Patent No.: US 11,352,236 B2
(45) Date of Patent: Jun. 7, 2022

(54) ELEVATOR CAR HAVING A MOVABLE CAR DOOR

(71) Applicant: Inventio AG, Hergiswil (CH)

(72) Inventor: Karl Erny, Holzhäusern (CH)

(73) Assignee: INVENTIO AG, Hergiswil (CH)

( * ) Notice: Subject to any disclaimer, the term of this patent is extended or adjusted under 35 U.S.C. 154(b) by 349 days.

(21) Appl. No.: 16/466,321

(22) PCT Filed: Dec. 1, 2017

(86) PCT No.: PCT/EP2017/081144

§ 371 (c)(1),
(2) Date: Jun. 4, 2019

(87) PCT Pub. No.: WO2018/114285

PCT Pub. Date: Jun. 28, 2018

(65) Prior Publication Data

US 2020/0031626 A1 Jan. 30, 2020

(30) Foreign Application Priority Data

Dec. 21, 2016 (EP) ..... 16205929

(51) Int. Cl.
*B66B 13/08* (2006.01)
*B66B 13/30* (2006.01)

(52) U.S. Cl.
CPC ..... *B66B 13/08* (2013.01); *B66B 13/30* (2013.01)

(58) Field of Classification Search
CPC ..... B66B 13/08; B66B 13/30; B66B 13/12
See application file for complete search history.

(56) References Cited

U.S. PATENT DOCUMENTS 1,866,392 A * 7/1932 Brady ..... B66B 13/08 187/324
2,878,532 A * 3/1959 Clark ..... E05D 15/1021 49/139
4,149,615 A * 4/1979 Kappenhagen ..... B66B 13/08 187/324
4,753,038 A * 6/1988 Sohlstrom ..... E05D 15/1065 49/212
5,878,846 A * 3/1999 O'Donnell ..... B66B 13/08 187/318
6,416,144 B1 * 7/2002 Houston ..... A61L 2/26 312/209
7,117,559 B1 * 10/2006 Barber ..... E05D 15/063 16/97

(Continued)

FOREIGN PATENT DOCUMENTS

CA 2218799 A1 4/1998
CN 1185513 A 6/1998

(Continued)

*Primary Examiner* — Michael A Riegelman
(74) *Attorney, Agent, or Firm* — William J. Clemens; Shumaker, Loop & Kendrick, LLP

(57) ABSTRACT

An elevator system includes an elevator car with a car door arranged on the elevator car. The car door includes at least one door leaf movable in a translatory manner, a guide rail fastened to the elevator car, which guide rail forms a guide for the translatory movement of the door leaf, and a drive assembly for driving the door leaf. The drive assembly is movably mounted on the elevator car.

12 Claims, 3 Drawing Sheets

(56) References Cited

U.S. PATENT DOCUMENTS

| | | | | |
|---|---|---|---|---|
| 7,246,688 | B2 * | 7/2007 | Tonna | B66B 13/08 187/324 |
| 9,181,065 | B2 * | 11/2015 | Schumacher | B66B 13/143 |
| 2012/0048657 | A1 * | 3/2012 | Christen | B66B 13/301 187/330 |
| 2014/0138188 | A1 * | 5/2014 | Krause | B66B 13/08 187/319 |
| 2014/0332323 | A1 * | 11/2014 | Christen | B66B 13/12 187/330 |
| 2015/0047150 | A1 * | 2/2015 | Saito | E05F 1/16 16/103 |
| 2020/0031626 | A1 * | 1/2020 | Erny | B66B 13/30 |

FOREIGN PATENT DOCUMENTS

| | | | |
|---|---|---|---|
| CN | 102205923 | A | 10/2011 |
| CN | 103025641 | A | 4/2013 |
| DE | 2653328 | B1 | 12/1977 |
| EP | 2055663 | A1 | 5/2009 |
| JP | H07137966 | A | 5/1995 |
| JP | 2001322783 | A | 11/2001 |
| JP | 2006160420 | A | 6/2006 |
| JP | 2009091098 | A | 4/2009 |
| JP | 2010173768 | A | 8/2010 |
| WO | 2012025353 | A1 | 3/2012 |

* cited by examiner

ELEVATOR CAR HAVING A MOVABLE CAR DOOR

FIELD

The invention relates to an elevator system comprising a car door and a plurality of shaft doors arranged above one another, it being possible to couple the car door to each one of the shaft doors.

BACKGROUND

Elevator systems comprise an elevator car which is usually arranged such that it can move vertically within an elevator shaft. An elevator shaft of this kind connects several floors of a building. The elevator shaft comprises a plurality of shaft doors which are usually arranged above one another. The elevator car comprises a car door which can be positioned at each of the shaft doors. In order to enable passengers to enter or leave the elevator car that is positioned at the corresponding shaft door from the floor, the car door is coupled to this shaft door and synchronously opened or closed.

A door drive and a car door-shaft door coupling connected to the door drive are usually arranged on the car side. Coupling elements that can be actuated by the car door-shaft door coupling are arranged on the shaft door side. Once the car door is positioned at the shaft door, the car door and shaft door can therefore be coupled, which coupling is brought about by the door drive. Actuating the coupling elements thus usually first causes unlocking of the shaft door and subsequently a synchronous opening movement of the car door and shaft door. In order to be able to maintain trouble-free operation of the elevator system, it is necessary for each individual one of the shaft doors or the coupling elements thereof to be sufficiently accurately aligned with respect to the car door that can be arranged on said shaft door.

Particularly in the case of tall buildings and a correspondingly high number of shaft doors arranged above one another, this is complicated and linked to a high expenditure of time.

WO2012025353 discloses a car door which comprises a door drive and a door header, which door header is movably mounted on the elevator car. This is disadvantageous in that the door drive has to apply a high energy output, i.e. has to be correspondingly dimensioned so as to have high output, in order to effect a displacement of the door header, i.e. the alignment thereof, on the elevator car. Moreover, movably arranging the entire door header, together with all the components of the elevator door fastened thereto, on the elevator car requires solid bearing elements as a result of the weight of the door header.

SUMMARY

The problem addressed by the invention is therefore that of proposing an elevator system that uses energy more efficiently and is easier to mount.

This problem is solved by an elevator system comprising an elevator car and a car door arranged on the elevator car, wherein the car door comprises at least one translationally movable door leaf, a guide rail fixed to the elevator car, which guide rail forms a guide for the translational movement of the door leaf, and a drive arrangement for driving the door leaf, wherein the drive arrangement is movably mounted on the elevator car.

It is known that a car door can be coupled to a shaft door by means of a car door-shaft door coupling arranged on the car door. Counter elements on the shaft door side can be actuated by a car door-shaft door coupling of this kind, these counter elements being arranged so as to be largely immovable in the horizontal direction when the shaft door is in the locked state. The car door-shaft door coupling thus actuates the counter elements, as a result of which the shaft door is unlocked in a first step and is opened synchronously with the car door in a second subsequent step. The shaft door that is coupled to the car door in this way can correspondingly be closed and decoupled in an obvious manner when the sequence is reversed.

The horizontal position of the car door-shaft door coupling and therefore the elements of the car door which are rigidly connected, in terms of their horizontal mobility, to this car door-shaft door coupling are determined or set by means of the door drive and therefore directly by means of the drive arrangement, preferably the belt drive arrangement. This means that a movement of the door drive directly causes a movement of the car door-shaft door coupling. The door drive is usually operatively connected directly to the drive arrangement, the drive arrangement being operatively connected directly to the car door-shaft door coupling.

The door leaf is an example of an element which is rigidly connected to this car door-shaft door coupling in terms of its horizontal mobility. The car door-shaft door coupling is mounted on the door leaf or on an element fixed to the door leaf.

In this case, a path which usually extends horizontally and along which the car door-shaft door coupling, or the aforementioned elements can be translationally moved during the opening or closing movement is predefined by the alignment of the guide rail.

The invention is based on the knowledge that only the car door-shaft door coupling and the mentioned elements of the car door that can move together with this car door-shaft door coupling should be displaced in order to achieve the desired alignment of the car door with respect to the shaft door that is to be coupled to this car door. Moreover, the desired displacement of the car door-shaft door coupling and the aforementioned elements connected to the car door-shaft door coupling is carried out, with respect to the alignment thereof, in the direction of the door opening or closing movement of the door leaf so as to correspond with the arrangement of the guide rail. It is advantageous for the bearing, which facilitates the alignment of the car door, to be subjected to as low mechanical loads as possible.

Therefore, when the car door-shaft door coupling is actuated, it is possible to achieve alignment of the car door when only the drive arrangement is movably mounted.

The drive arrangement can in this case preferably be mounted on the elevator car such that the drive arrangement is arranged in a starting position before the car door is coupled to the shaft door, and is moved back into this starting position after the car door is decoupled from the shaft door.

In the present context, "movably mounted on the elevator car" means that the drive arrangement itself can be displaced or is displaceably mounted as a whole on the elevator car. This means that essential elements of the drive arrangement, such as a drive belt or deflection elements for deflecting the drive belt, assume a different place on the car front by means of a displacement of this kind.

Therefore, moving essential elements for the purpose of moving the door leaves, for example circulating the drive belt around the deflection elements or rotating the mounted deflection elements, which is also a movement of these elements, is not a movement or displacement within the meaning of the expression "movably mounted on the elevator car".

In one embodiment of the elevator system, the drive arrangement is mounted on the elevator car such that it can move in parallel with the alignment of the guide rail. During an alignment movement of this kind, the car door-shaft door coupling and the mentioned elements that are rigidly connected to the car door-shaft door coupling can be displaced along the guide rail.

Moreover, the drive arrangement can be mounted on the elevator car such that it can move horizontally. Despite the presence of the weight force, this allows the drive arrangement to be held in a position without having to apply a high amount of force from the door drive motor for this purpose.

In one embodiment of the elevator system, the drive arrangement comprises deflection elements and a circulating drive belt that is deflected by means of the deflection elements, and the drive belt is coupled to the at least one door leaf in order to drive the at least one door leaf, wherein the deflection elements are constantly spaced apart and movably mounted on the elevator car. Movably mounting the two deflection elements allows a single bearing to be used. A drive arrangement of this kind is correspondingly designed as a belt drive arrangement. The deflection elements can be designed as deflection rollers. This easily allows the axles of deflection rollers of this kind to be movably mounted or arranged on the elevator car.

In one embodiment of the elevator system, the belt drive arrangement comprises the door drive motor. This therefore allows a coupling between the door drive motor and the driven deflection roller of the belt drive arrangement to be designed, in a simple or low complexity manner, so as to be constantly spaced apart.

In one embodiment of the elevator system, the door drive motor is coaxial with respect to one of the deflection elements. This allows the mounting of the belt drive arrangement to be simple or without a high number of components.

One embodiment of the elevator system comprises a connecting element for connecting the two constantly spaced deflection elements and a deflection element guide for guiding the deflection elements. This means that the deflection elements, independently of the movable mounting of the drive arrangement, have a constant distance from one another. This provides an opportunity to achieve the movable mounting of the drive arrangement.

In one embodiment of the elevator system, the connecting element is movably mounted on the elevator car by means of at least two identical springs or shock absorbers which are arranged so as to be mirror-symmetrical. This type of spring, shock absorber or equivalent element can be provided in order to hold the drive arrangement in a starting position. The drive arrangement is thus then arranged in this starting position when the car door comprising the drive arrangement is not coupled to a shaft door. A drive arrangement arranged in this starting position results in the car door-shaft door coupling not being able to collide with the counter elements on the shaft door side despite the displaceable drive arrangement.

In one embodiment of the elevator system, the car door is a centrally opening car door comprising two door leaves, wherein a car door-shaft door coupling is arranged on each of these two door leaves. This means that the locks of the two door leaves can be unlocked by aligning of the car door with respect to the counter elements on the shaft door side before the intended opening of the shaft door that is coupled to the car door. This therefore increases the functionality of the elevator system. It should be noted that, for car doors which are designed as telescopic doors, a car door-shaft door coupling of this kind is only arranged on the guiding door leaf or on at least one of the guiding door leaves or the door support of said leaf/leaves.

In one embodiment of the elevator system, the car door comprises a door header fixed to the elevator car, to which door header the guide rail is fixed, wherein the drive arrangement is movably mounted on the door header. The door header on which as far as possible all the components of the elevator door are fixed or mounted allows the car door to be prefabricated and calibrated before the elevator system is installed.

DESCRIPTION OF THE DRAWINGS

The invention is explained in greater detail in the following with reference to drawings, in which.

Figure 2:
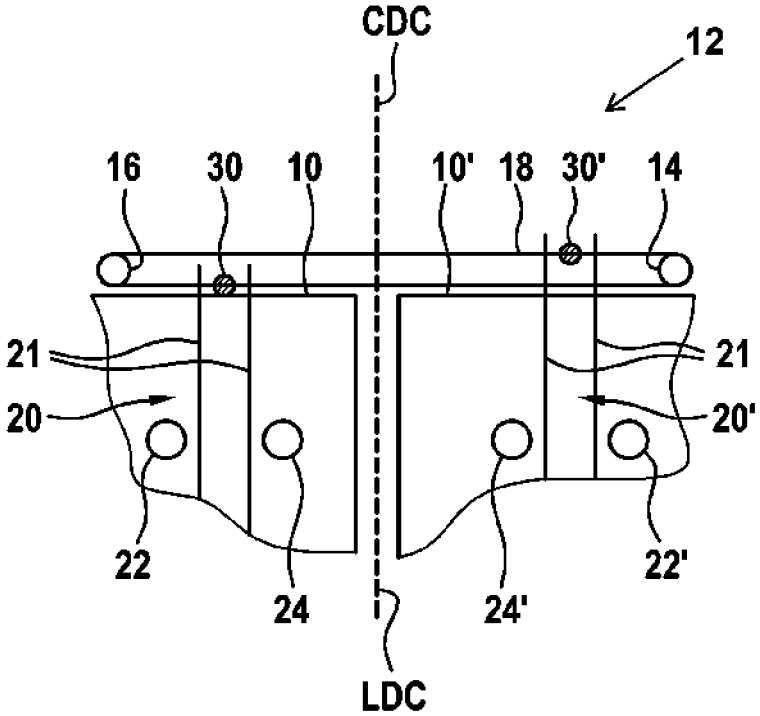
FIG. 2 is a schematic view of a car door comprising a belt drive arrangement and coupling elements of a shaft door.
Figure 3:
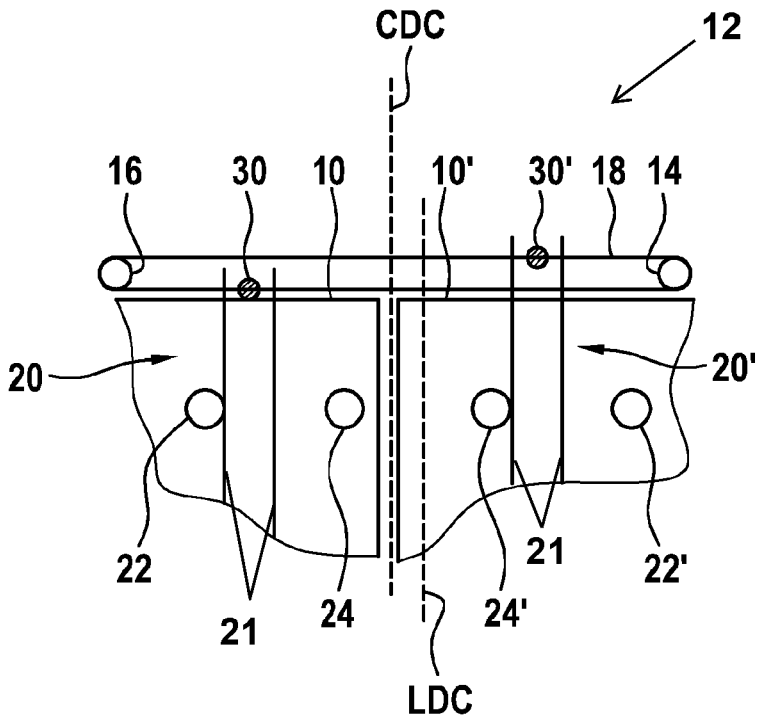
Figure 4:
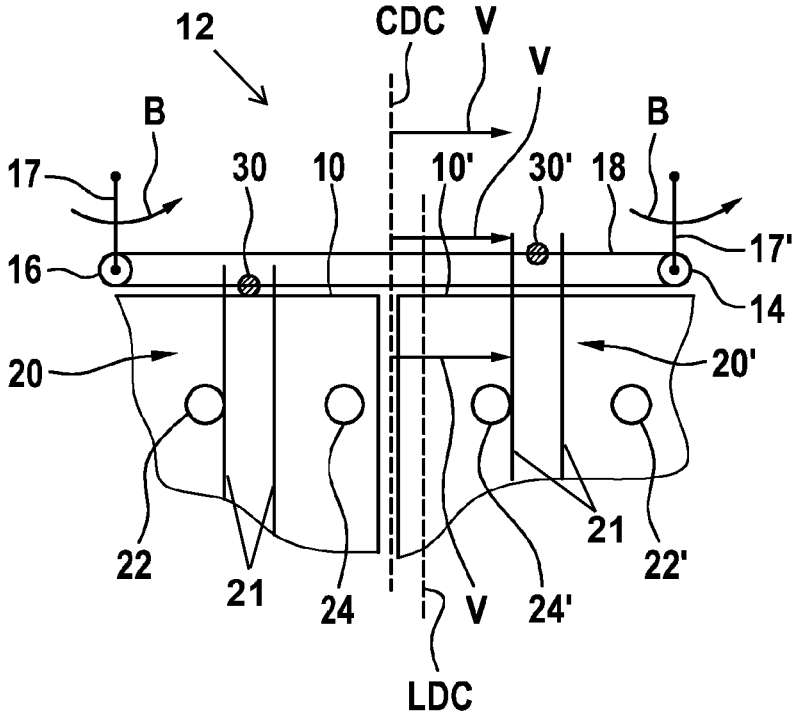
Figure 5:
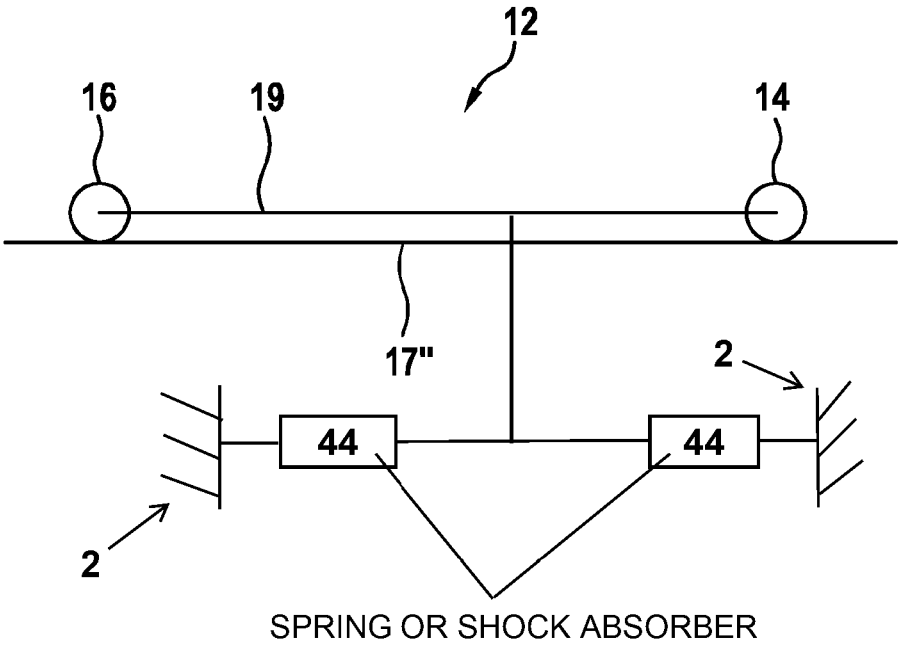

coupling elements of a shaft door;

FIG. 3 shows the arrangement according to FIG. 2, with the car door being arranged so as to not be aligned with respect to the shaft door;

FIG. 4 is a schematic view of a car door comprising a belt drive arrangement that is mounted such that it can move horizontally according to a first embodiment and the coupling elements of a shaft door; and FIG. 5 shows the deflection elements of a belt drive arrangement, which elements are mounted such that they can move horizontally, according to a second embodiment.

DETAILED DESCRIPTION

Figure 1:
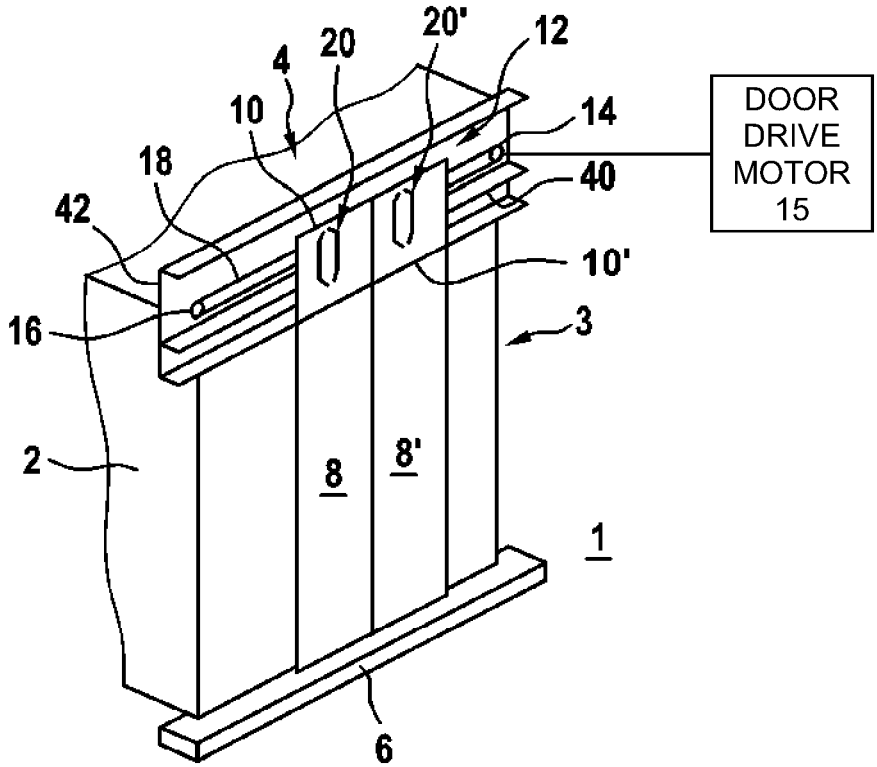
FIG. 1 is a front view of an elevator car.

FIG. 1 shows a front view of an elevator car 2, which elevator car 2 is arranged in an elevator shaft 1 so as to be vertically movable. The elevator car 2 has a car front 3. A car door 4 is arranged on the car front 3. As shown in FIG. 1, the car door 4 can comprise a door header 42 arranged in the upper region of the car front 3, on which door header further elements of the car door 4 are arranged. As an alternative thereto or to the following description of FIG. 1, these elements can be arranged or mounted or fixed in the upper region of the car front 3 without the presence of a door header 42 of this kind.

The car door 4 also comprises two door leaves 8, 8', a guide rail 40, a car door sill 6 and a belt drive arrangement 12. The guide rail 40 is fixed to the door header 42 and is provided for guiding the at least one door leaf 8, 8'. The door leaves 8, 8' can be guided by means of the car door sill 6 in the lower region of the car front 3. The door leaves 8, 8' can be translationally moved along the car door sill 6 or the guide rail 40. Each one of the door leaves 8, 8' is fixed to a door support 10, 10' associated with the door leaf 8, 8'.

The door support 10, 10' comprises elements (not shown in FIG. 1) for guiding along the guide rail 40. These aforementioned elements are usually formed at least by guide rollers.

A car door-shaft door coupling 20, 20' is arranged on each of the door supports 10, 10' shown in FIG. 1. It should be noted that, for car doors which are designed as telescopic doors, a car door-shaft door coupling 20, 20' of this kind is only arranged on the guiding door leaf or on at least one of the guiding door leaves or the door support of said leaf/leaves.

The belt drive arrangement 12 comprises a first deflection roller 14, a second deflection roller 16 and a drive belt 18, which drive belt 18 is guided around these deflection elements 14, 16. According to FIG. 1, the deflection elements 14, 16 are designed as deflection rollers. The belt drive arrangement 12 can comprise a door drive motor 15 which is coupled to one of the deflection elements 14, 16 in order to drive the door leaves 8, 8'. Moreover, the shaft of the door drive motor 15 can be arranged coaxially with respect to the axle of the one deflection element 14, 16 that is designed as a deflection roller.

Alternatively, the door drive motor can be arranged on the car front without being part of the belt drive arrangement 12. Correspondingly, the driving force of the door drive motor can be transmitted to at least one of the deflection elements, for example, by means of a resilient circulating belt.

In order to enter the elevator car 2 from a floor or to leave this elevator car 2, the elevator car 2 has be arranged vertically at the same height as the shaft door (not shown) that is associated with this floor. Correspondingly, the car door 4 and the shaft door can be coupled.

FIGS. 2, 3 and 4 are schematic views of car doors comprising belt drive arrangements 12 and counter elements 22, 24, 22', 24' of shaft doors, with FIGS. 2 and 3 showing a car door and a shaft door arranged thereon in a state in which they are aligned with one another (FIG. 2) and in a state in which they are not aligned with one another (FIG. 3). The car door shown in FIG. 4 also comprises a movably mounted belt drive arrangement 12.

The car doors comprise a first car door-shaft door coupling 20 on the left-hand side and a second car door-shaft door coupling 20' on the right-hand side, which couplings are mounted on the corresponding door supports 10, 10' of the car door. Each one of the car door-shaft door couplings 20, 20' comprises a pair of drive runners 21, these drive runners 21 usually being aligned in parallel with the direction of travel of the elevator car and being provided for actuating the counter elements 22, 24, 22', 24' during coupling. The counter elements 22, 24, 22', 24' on the shaft door side usually comprise, relative to each car door-shaft door coupling 20, 20', a stationary counter element 22, 22' and an unlocking roller 24, 24'.

Each one of the car door-shaft door couplings 20, 20' is rigidly connected to the drive belt 18 of the belt drive arrangement 12 at a fastening point 30, 30' that is associated with the car door-shaft door couplings 20, 20'.

During travel of the elevator car, the drive runners 21 that belong to an individual car door-shaft door coupling 20, 20' are folded, i.e. are spaced apart from one another at a comparatively small distance. In order to couple the car door and the shaft door, the two drive runners 21 of each car door-shaft door coupling 20, 20' are spread apart from one another. These drive runners 21 are correspondingly at a large distance from one another when in the coupled state.

FIG. 2 shows a car door 4 that is aligned with respect to the shaft door. This means that the car door center CDC is covered by the shaft door center LDC.

FIG. 3 shows the arrangement shown in FIG. 2, the shaft door being arranged so as to not be aligned with respect to the car door 4. Correspondingly, the car door center CDC and the shaft door center LDC are not congruent. When the car door 4 begins to open, the drive runners 21 of the car door-shaft door couplings 20, 20' are spread apart. When the car door-shaft door couplings 20, 20' are spread apart, the shaft door leaf which is associated with the first unlocking roller 24' is unlocked. Otherwise, the shaft door leaf which is associated with the first car door-shaft door coupling 20 is not unlocked or cannot be unlocked because none of the drive runners 21 of the first car door-shaft door coupling 20 actuates or contacts the unlocking roller 24 that is associated with the first car door-shaft door coupling 20.

The belt drive arrangement 12 shown in FIG. 4 comprises movably mounted deflection rollers 14, 16. The movable mounting is achieved by pivot levers 17, 17', a first end of these pivot levers 17, 17' being fixed to the elevator car 4 or, when there is a door header present, to the door header. The mounting of the deflection rollers 14, 16 can in this case be designed such that the belt drive arrangement 12 can only be displaced horizontally. In order to be able to achieve a belt drive arrangement 12 that can be displaced substantially horizontally, the pivot levers 17, 17' can be longitudinally adjustable, for example.

The drive runners 21 that belong to the first and those that belong to the second car door-shaft door coupling 20, 20' are shown in the partially spread apart state. This means that the coupling of the car door to the shaft door is not fully completed. When the drive runners 21 spread apart further, the movable mounting of the deflection rollers 14, 16 results in the drive runner 21 of the first car door-shaft door coupling 20, which runner contacts the stationary counter element 22, pressing against this stationary counter element 22. Due to the movable mounting of the belt drive arrangement 12 and the horizontally fixed connection of the first car door-shaft door coupling 20 to the drive belt 18, the belt drive arrangement 12 is displaced in accordance with the arrow B shown in FIG. 4. Correspondingly, the car door is aligned with respect to the shaft door, which is shown by means of arrows V that denote a displacement of the car door center CDC. This merely results in the unlocking roller 24 associated with the first car door-shaft door coupling 20 being actuated after the drive runners 21 have been spread apart further.

FIG. 5 shows components of a belt drive arrangement 12. The belt drive arrangement 12 comprises a connecting element 19. The connecting element 19 causes the deflection rollers 14, 16 of the belt drive arrangement 12 to be constantly spaced apart despite the horizontal mobility of these deflection rollers 14, 16. The deflection elements 14, 16 are also guided along a deflection element guide 17". The deflection element guide 17" is fixed horizontally to the elevator car 2 or to the door header 42.

The deflection rollers 14, 16 which are constantly spaced apart, or alternatively the connecting element 19, can be movably mounted on the elevator car 2 by means of two identical springs or shock absorbers 44 which are arranged so as to be mirror-symmetrical, for example. Once the car door-shaft door coupling 20 does not contact the counter elements, i.e. the car door is decoupled from the shaft door, the belt drive arrangement is thus arranged in a starting position.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator system including an elevator car and a car door arranged on the elevator car, the car door comprising:

a translationally movable door leaf;

a guide rail stationarily fixed to the elevator car in an alignment for guiding the translational movement of the door leaf;

a drive arrangement driving the door leaf in the translational movement, wherein the drive arrangement is movably mounted on the elevator car;

wherein the drive arrangement includes a pair of deflection elements and a circulating drive belt that is deflected by the deflection elements, wherein the drive belt is coupled to the door leaf to drive the door leaf in the translational movement, and wherein the deflection elements are spaced apart by a constant distance and are movably mounted on the elevator car; and a connecting element connecting the deflection elements and a deflection element guide for guiding the deflection elements during the translational movement.

2. The elevator system according to claim 1 wherein the drive arrangement is mounted on the elevator car for movement in parallel with the alignment of the guide rail.

3. The elevator system according to claim 2 wherein the drive arrangement is mounted on the elevator car for movement horizontally.

4. The elevator system according to claim 1 wherein the deflection elements are deflection rollers.

5. The elevator system according to claim 1 wherein the drive arrangement includes a door drive motor for driving the drive belt.

6. The elevator system according to claim 5 wherein the door drive motor is coaxial with respect to one of the deflection elements.

7. The elevator system according to claim 1 wherein the connecting element is movably mounted on the elevator car by springs or shock absorbers arranged to be mirror-symmetrical.

8. The elevator system according to claim 1 wherein the car door is a centrally opening car door having two of the door leaf and including a separate car door-shaft door coupling arranged on each of the door leaves.

9. The elevator system according to claim 1 wherein the car door includes a door header fixed to the elevator car, the guide rail being fixed to the door header, and wherein the drive arrangement is movably mounted on the door header.

10. The elevator system according to claim 9 wherein the drive arrangement is a belt drive arrangement.

11. An elevator system including an elevator car and a car door arranged on the elevator car, the car door comprising:

a translationally movable door leaf;

a guide rail fixed to the elevator car in an alignment for guiding the translational movement of the door leaf;

a drive arrangement driving the door leaf in the translational movement, wherein the drive arrangement is movably mounted on the elevator car;

wherein the drive arrangement includes a pair of deflection elements and a circulating drive belt that is deflected by the deflection elements, wherein the drive belt is coupled to the door leaf to drive the door leaf in the translational movement, and wherein the deflection elements are spaced apart by a constant distance and are movably mounted on the elevator car; and a connecting element connecting the deflection elements and a deflection element guide for guiding the deflection elements during the translational movement.

12. The elevator system according to claim 11 wherein the connecting element is movably mounted on the elevator car by springs or shock absorbers arranged to be mirror-symmetrical.

* * * * *